United States Patent [19]

Braddick

[11] 4,106,565

[45] Aug. 15, 1978

[54] SEAL NIPPLE PACKER

[75] Inventor: Britt O. Braddick, Houston, Tex.

[73] Assignee: Texas Iron Works, Inc., Houston, Tex.

[21] Appl. No.: 787,856

[22] Filed: Apr. 15, 1977

[51] Int. Cl.[2] ..... E21B 23/00

[52] U.S. Cl. ..... 166/118; 166/182; 166/208

[58] Field of Search ..... 166/118, 134, 138, 139, 166/208

[56] References Cited

U.S. PATENT DOCUMENTS

| | | | |
|---|---|---|---|
| 1,804,818 | 5/1931 | Spang | 166/118 |
| 2,753,941 | 7/1956 | Hebard et al. | 166/134 |
| 2,791,278 | 5/1957 | Clark, Jr. | 166/134 |

*Primary Examiner*—James A. Leppink
*Attorney, Agent, or Firm*—Jack W. Hayden

[57] ABSTRACT

A tubular member is provided with seals thereon for sealing in a liner receptacle supported in a well string in a well bore. Expandable seal means are provided on the tubular member with actuating means for expanding the expandable members into engagement with the well string above the receptacle, and releasable retaining means engage the actuating means with the tubular member to retain the actuating means in a non activated position until the releasable retaining means are actuated. Additional means secure the actuating means on the tubular member to inhibit premature release of the releasable retaining means as the seal nipple packer is lowered through the well string to be positioned in the receptacle. Slip segments are releasably connected to an expander cone, with both being mounted on the tubular member in longitudinal spaced relation to the actuating means at the other end of the expandable seal means.

4 Claims, 2 Drawing Figures

SEAL NIPPLE PACKER

SUMMARY OF THE INVENTION

Where a liner is positioned in a well casing in any suitable manner well known in the art to form an extension thereof, it may be desirable under some circumstances to thereafter position a well string from adjacent the liner and extending upwardly in the well string towards the earth's surface a desired distance. When this is to be done it is desirable that the extension of the well string upwardly towards the earth's surface be sealed off within the liner receptacle and between the extension and the surrounding well string immediately above the liner receptacle.

Heretofore this has been accomplished by providing a suitable packing arrangement on an elongated tubular member which could be lowered into the well string and into the liner receptacle for forming a seal therewith. The tubular member also included a collar which was connected to the tubular member by a shear pin with expandable packer means positioned on the tubular member above the collar so that the collar could be engaged against the liner receptacle and the pin sheared so that the collar could be moved to expand the expandable packer means outwardly to sealingly engage the tubular member and the well string above the liner receptacle. The tubular member would have a desired number of pipe lengths connected therewith to provide an upwardly extension of whatever length desired. In other situations, it is desirable to seal within a receptacle and above a receptacle without an upward extension.

Such device, while functioning, as intended, sometimes prematurely actuated before it reached the liner receptacle by reason of premature shearing of the pin which secures the collar to the tubular member. By way of example only, it can be appreciated that as the tubular member with the expandable packer thereon and the collar abutted thereto is lowered into the well bore, the lower end of such collar might engage a projection, ledge, or some other obstruction in the well bore which would shear the pin and cause the collar to tend to move against the expandable packers and urge them outwardly.

In other instances, moving the tubular member with the expandable packer means and the collar thereon down through the well string might create sufficient hydraulic force against the lower end of the collar to prematurely shear the pin connecting the collar to the tubular member and urge the collar against the packer means to tend to radially expand them.

The present invention overcomes this problem in that it includes additional means to inhibit premature release of the shear pin or other releasable retainer means and thus prevent movement of the setting sleeve or collar which abuts the expandable packer means until the arrangement is engaged with the upper end of the liner receptacle in a desired manner to effect shearing of the pin and subsequent expansion of the expandable packer means to sealingly engage the well string above the liner receptacle.

Still another object of the present invention is to provide a seal nipple packer arrangement including a tubular member with seal means thereon for sealingly engaging with a liner receptacle forming the extension of a casing or well string and additional expandable packer means spaced longitudinally thereof with actuating means for causing expansion of the expandable packer means into engagement with the well string above the liner receptacle. The actuating means is constructed and arranged so as to absorb a maximum amount of load exerted thereagainst while being lowered through the well string, but which may be readily manipulated by engagement with the upper end of the liner receptacle for expansion of the expandable packer means into sealing engagement with the casing string surrounding the liner receptacle adjacent its upper end.

Other objects and advantages of the present invention will become more readily apparent from a consideration of the following description and drawings.

PREFERRED EMBODIMENT OF THE PRESENT INVENTION

Figure 1:
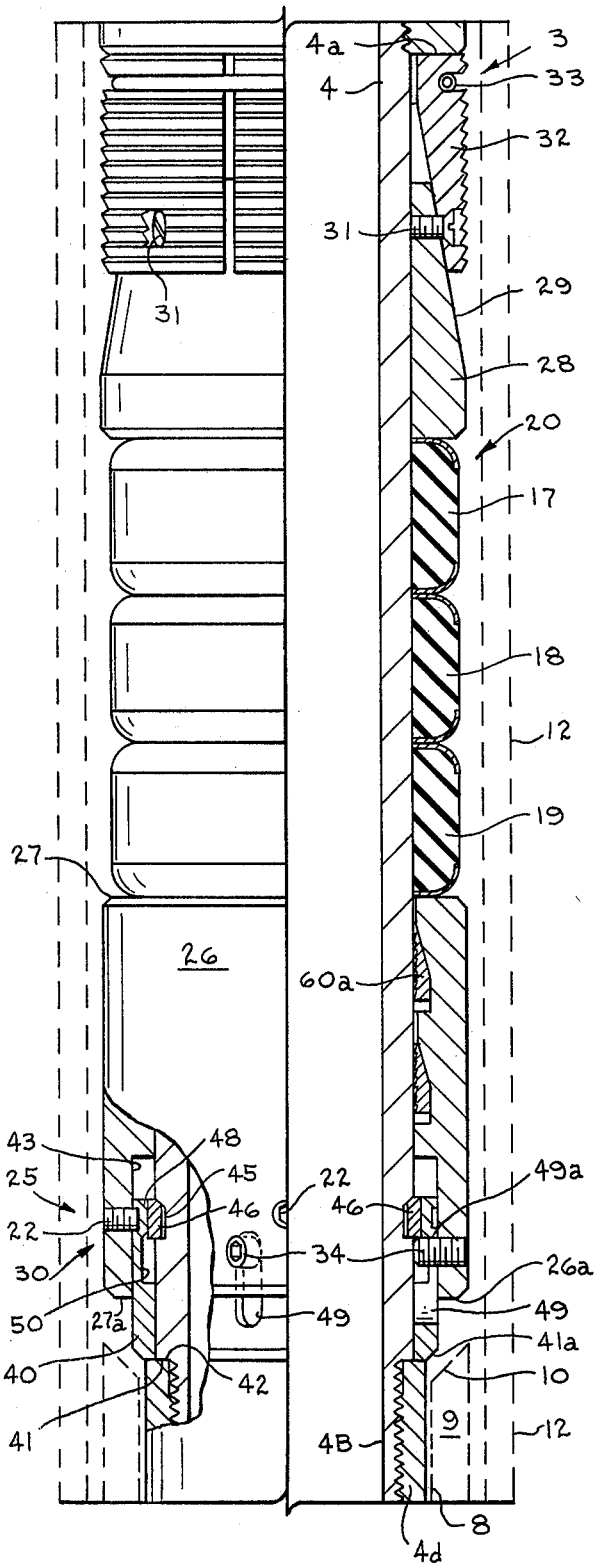
FIG. 1 is a partial vertical sectional view partly cut away to illustrate the operating components of the present invention.
Figure 2:
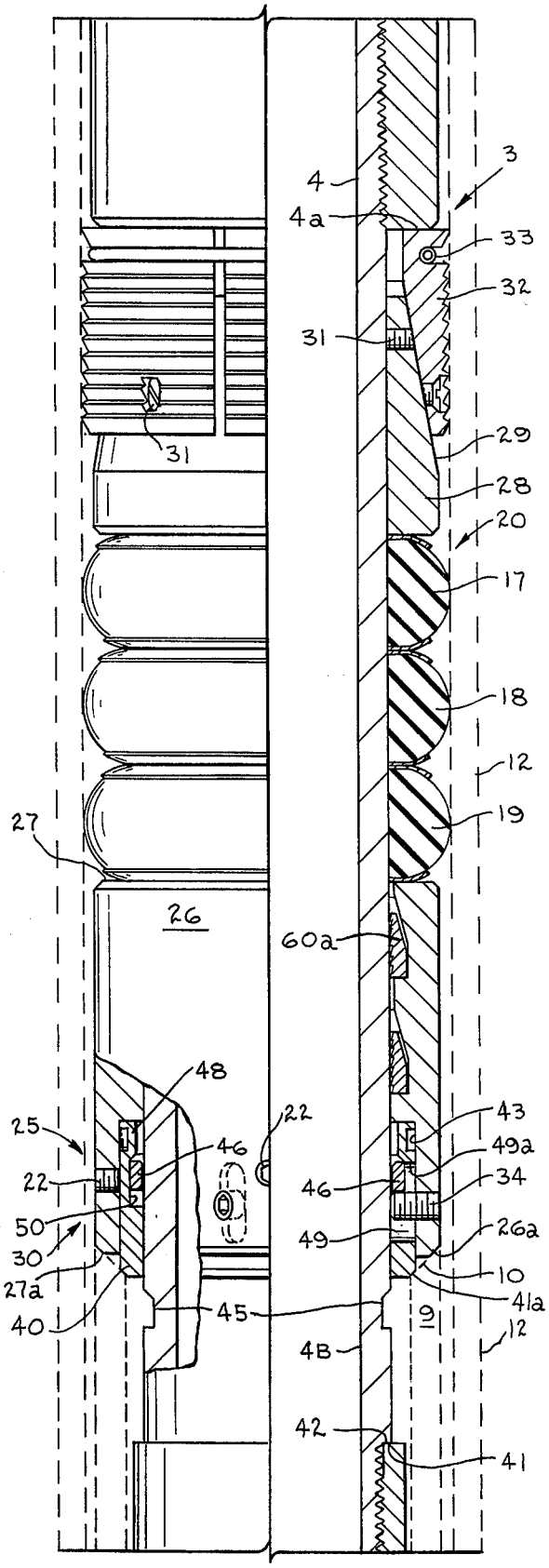
FIG. 2 is a sectional view similar to FIG. 1 but illustrating the relative position of the components after the releasable retaining means such as a shear pin means has been actuated and the actuating means actuated to move the expandable packer means into engagement with the well string surrounding the upper end of the receptacle.

Attention is first directed to FIG. 1 wherein the seal nipple packer of the present invention is illustrated generally by the numeral 3 and includes a tubular member 4 of desired longitudinal extent. Its lower end is provided with suitable packing, such as Chevron packing or the like that is adapted to frictionally engage the inner surface 8 of the liner receptacle 9 and sealingly engage therewith. The Chevron packing on the lower end of the tubular member 4 is not illustrated, as such arrangement is well known in the art.

The liner receptacle 9 is positioned in the well string 12 by means well known in the art and forms an extension thereof. The seal nipple packer 3 is employed where it is desired to seal off between the liner receptacle 9 and the well string 12 of which the liner receptacle 9 is an extension for anyone of several reasons, the Chevron packing (not shown) serving to seal off between the liner receptacle 9 and the lower portion 4B of the tubular member which is telescopically received within such liner receptacle 9 while the expandable packer means on the tubular member 4 and referred to generally at 20 is adapted to sealingly engage the casing 12 above the upper end 10 of the liner receptacle 9 whereby the tubular member 4 is sealed in position with the well casing 12 above the liner receptacle 9 as well as within the liner receptacle 9. Actuating means referred to generally at 25 are provided for expanding the expandable seal or packer means 20 into engagement with the well string 12 above the upper end 10 of the liner receptacle 9 and includes additional means referred to generally at 30 for inhibiting premature release of the releasable retaining means 22, shown by way of example only as comprising shear pins 22, and thus the actuating means 25 as the seal nipple packer 3 is lowered through the well string 12 towards the receptacle 9.

It will be noted that shear pin means 12 are provided at circumferentially spaced intervals to connect the actuating means 25 with the tubular member 4 to inhibit premature release thereof. The additional means 30 cooperates with the shear pin means 22 to retain the actuating means 25 in the position illustrated in FIG. 1 of the drawings to inhibit premature release as the tubular member 4 is lowered in the well string 12 in a conventional manner.

The actuating means 25 includes a setting sleeve 26 which surrounds the tubular member 4 as shown with the upper end 27 thereof abutting one end of the expandable packer or seal means 20. As shown in the drawings the expandable packer means 20 is formed of three solid annular elastomer members 17, 18 and 19 which are mounted on the outer circumference of the tubular member 4 between the upper end 27 of the setting sleeve 26 and the conical collar 28. The collar 28 includes an annular tapered surface 29, such collar 28 being secured by shear pin means 31 to annular slip segments 32 which are resiliently retained in position on the tubular member 4 by the spring 33. The slip segments abut shoulder 4A of the tubular member 4 as shown in the drawings.

The additional means referred to generally at 30 includes a releasing sleeve 40 whose lower end 41 abuts the shoulder 42 on the upper end of tubular member **4*d* forming part of the tubular member 4 when the components of the present invention are in assembled relationship for lowering into the well string 12 as shown in FIG. 1 of the drawings. The releasing sleeve 40 telescopically fits or is received within the annular recess 43 formed in the end 27*a* of the setting sleeve 26**.

An annular groove 45 is provided on the outer surface on the tubular member 4 on which is positioned a split keeper ring 46 as shown in FIG. 1 of the drawings. The releasing sleeve 40 includes an annular, inwardly extending projection 48 which abuts the outer periphery of the split keeper ring 46 when the components of the invention are assembled for lowering into the well string 12 as shown in FIG. 1 and the releasing sleeve 40 further includes the annular recess 50 adjacent annular enlargement 48 to accommodate movement of the split keeper ring 46 out of the groove 45 after the release sleeve 40 has been moved longitudinally of the tubular member 4 in a manner as will be described.

It will be noted that the shear pin means 22 engage through the setting sleeve 26 and with the releasing sleeve 40 as shown in FIG. 1 whereby the releasing sleeve 40 abuts and retains the keeper ring 46 in the groove 45 when the components are assembled as shown in FIG. 1 for lowering into the well bore.

The setting sleeve 26 includes projection means 34 secured to the sleeve 26 which projections are provided at circumferentially spaced intervals of the setting sleeve 26 as shown in the drawings. Longitudinally extending grooves 49 are provided in the releasing sleeve 40 and a projection means 34 is engaged with one end **49*a* of each of the slots 49 when the components are in the relationship shown in FIG. 1 of the drawings. It will also be noted that at such time the projections 34 also abut the circumferential edge of keeper ring 46**.

Since the circumferentially spaced projection means 34 abut the end **49*a* of the circumferentially spaced slots 49 in release sleeve 40 and also abut the circumferential edge of keeper ring 46 and since the release sleeve 40 abuts the keeper ring 46 and holds it in groove 45 with the release sleeve 40 in turn being secured to setting sleeve 26 by shear pin means 22, it can be appreciated that all the components of the actuating means 25 and additional means 30 are secured together with the tubular member 4 as the tubular member 4 is lowered in the well string 12**.

Thus, as the invention 3 is lowered into the well bore any load applied to the lower end of the actuating means 25 will be transmitted through the setting collar or sleeve 26, projections 34, keeper ring 46 and thus to the tubular member 4 on which the keeper ring 46 is secured as the tubular member 4 is lowered in the well bore. This inhibits premature release of the actuating means 25 comprising the sleeve 25 should such engage a projection, or should the manner or rate of lowering cause a substantial hydraulic force to be applied against the lower end of the collar 26.

When the seal nipple packer arrangement 3 of the present invention reaches the upper end 10 of the liner receptacle 9, engagement of the outwardly projecting portion **41*a* of lower end 41 of the release sleeve 40 with the upper end 10 of the liner receptacle 9 will cause the releasable retaining means 22 to actuate. In the embodiment illustrated, the shear pin means 22 will shear, thus disengaging the release sleeve 40 from the shear pins 22. This enables the release sleeve 40 to telescope longitudinally into the annular recess 43 in the end of the setting sleeve 26 as the tubular member 4 is lowered and in turn disengages enlargement 48 from the keeper ring 46**.

The longitudinal movement of the release sleeve 40, into setting sleeve 26 also positions the annular recess portion 50 of such release sleeve 40 over or adjacent the split keeper ring 46 to thus accommodate outward movement of the keeper ring 46 from the groove 45 in the tubular member 3 in a manner as will be described.

Continued lowering of the tubular member 4 of the present invention into receptacle 9 will then engage the lower end **26*a* of the setting sleeve 26 with the upper end 10 of the liner receptacle 9 and the projection means 34 will move the keeper ring 46 out of the groove 45 and will move the releasing sleeve 40 upwardly within the annular recess 43 until it engages the inner end thereof. Movement of sleeve 26 causes the annular, tapered surface 29 of sleeve 28 to move and shear the pins 31. Thus the slip segments 32 are moved radially outwardly into frictional engagement with the well string 12 as the tubular member 4 is lowered through setting sleeve 26 that is held against the upper end 10 of liner receptacle 9**.

Lowering of tubular member 4 not only sets slip segments 32 against well string 12 but the setting sleeve 26 abuts the expandable, elastomer seals means 20 and they move outwardly into sealing engagement with the well string 12. The tubular member 4 is thus sealed within the liner receptacle 9 by the Chevron packing on the lower end 4B thereof and is sealed with the well string 12 above the receptacle 9 by the packer means 20. The slip segments 32 by reason of their engagement with the well string 12 to prevent upward travel of the packer means 20, and the split locking rings **60*a* in sleeve 26 by reason of their engagement with tubular member 4 to prevent downward travel of the sleeve 26 on tubular member 4 will maintain such sealing relationship between tubular member 4 and receptacle 9 and between tubular member 4 and well string 12. In some instances, the hold down slips 32** may not be employed.

From the foregoing description, it can be seen that the present invention provides a means to urge the actuating means 25 in position to inhibit premature release thereof until the seal nipple arrangement 3 of the present invention is positioned at the desired elevation in the well string relative to the liner receptacle 9 for sealingly engaging between the liner receptacle 9 and the tubular member 3 as well as sealingly engaging between the well string 12 and the tubular member 4. Thereafter, additional sections of the tubular members may be connected to the tubular member 4 in a manner well known in the art, or disconnected therefrom in a manner well known in the art to provide an extension extending upwardly from the liner receptacle a desired distance.

The foregoing disclosure and description of the invention are illustrative and explanatory thereof, and various changes in the size, shape, and materials as well as in the details of the illustrated construction may be made without departing from the spirit of the invention.

What is claimed is:

1. In a seal nipple packer having a tubular member with seals thereon for sealing in a receptacle supported in a well string, the invention including:

a. expandable seal means on the tubular member for sealing with the well string above the receptacle;

b. actuating means including a setting sleeve movable on the tubular mandrel for expanding said expandable seal means into engagement with the well string;

c. releasable retaining means engaged with said actuating means and the tubular member to retain said actuating means in a non activated position until said releasable retaining means is actuated by engagement of said actuating means with the receptacle;

d. additional means to inhibit premature release of said releasable retaining means as the seal nipple packer is lowered through the well string, said additional means including:

1. an annular groove on the tubular member;

2. a split keeper ring in the groove;

3. a releasing sleeve which at one end thereof abuts a shoulder on the tubular member, said releasing sleeve being telescopically received within said setting sleeve and having a portion overlapping and abutting said keeper ring to retain it in the groove in the tubular member;

4. projection means secured with said setting sleeve and abutting said releasing sleeve and keeper ring; and 5. said releasable retaining means securing said setting sleeve and said releasing sleeve together to retain said projection means in abutting relationship with said releasing sleeve and keeper ring and to retain said releasing sleeve in abutting relationship over said keeper ring.

2. The invention of claim 1 wherein said releasing sleeve includes:

a. longitudinal slots to receive said projection means and accommodate movement of said releasing sleeve into the setting sleeve when said releasable retaining means is actuated; and b. an annular recess thereon for receiving said keeper ring to enable said keeper ring to withdraw from the groove in the tubular member whereupon engagement of said setting sleeve with the receptacle moves said releasing sleeve, keeper ring and setting sleeve along the tubular member to expand said expandable seal means into engagement with the well string.

3. The invention of claim 2 wherein:

a. slip segments are resiliently supported on the tubular member; and b. an annular, cone shaped member releasably connected to said slip segments and abutting said expandable seal means so that movement of said expandable seal means by said setting sleeve engages said slip segments with the well string.

4. The invention of claim 2 including lock rings carried by the setting sleeve for engaging the tubular member to retain said expandable seal means expanded.

* * * * *